United States Patent [19]

Lederbauer

[11] Patent Number: 4,785,577

[45] Date of Patent: Nov. 22, 1988

[54] NOISE-ABSORBING CONSTRUCTION HAVING LIVE PLANTS

[76] Inventor: Marion Lederbauer, A-1010 Wien, Dominikanerbastei 6, Austria

[21] Appl. No.: 67,775

[22] Filed: Jun. 10, 1987

[30] Foreign Application Priority Data

| | | | |
|---|---|---|---|
| Oct. 17, 1985 | [AT] | Austria | 3017/85 |
| Oct. 17, 1985 | [AT] | Austria | 3014/85 |
| Oct. 17, 1985 | [AT] | Austria | 3015/85 |
| Oct. 17, 1985 | [AT] | Austria | 3016/85 |
| Oct. 16, 1986 | [WO] | PCT Int'l Appl. | PCT/AT86/00066 |

[51] Int. Cl.[4] ..... A01G 1/00; E01F 8/00; E01F 15/00

[52] U.S. Cl. ..... 47/33; 47/83; 52/DIG. 9; 404/6; 405/284; 256/13.1

[58] Field of Search ..... 47/33, 82, 83; 52/DIG. 9; 256/1, 13.1; 404/6, 9; 405/30, 284, 286

[56] References Cited

U.S. PATENT DOCUMENTS

| | | | |
|---|---|---|---|
| 2,032,511 | 3/1936 | Stevenson | 52/DIG. 9 |
| 2,279,944 | 4/1942 | Hendry | 52/DIG. 9 |
| 2,874,669 | 2/1959 | Norman | 52/DIG. 9 |
| 3,848,853 | 11/1974 | Way et al. | 256/13.1 |
| 3,928,701 | 12/1975 | Roehner | 256/13.1 |
| 3,951,384 | 4/1976 | Hildreth, Jr. | 256/13.1 |
| 4,022,434 | 5/1977 | Moore | 404/6 |
| 4,080,793 | 3/1978 | Pulsifer | 405/30 |
| 4,188,153 | 2/1980 | Taylor | 405/30 |

FOREIGN PATENT DOCUMENTS

| | | |
|---|---|---|
| 346893 | 11/1978 | Austria . |
| 372443 | 10/1983 | Austria . |
| 2552320 | 6/1977 | Fed. Rep. of Germany . |
| 2705375 | 6/1978 | Fed. Rep. of Germany . |
| 8513539 | 9/1985 | Fed. Rep. of Germany . |
| 1430536 | 10/1966 | France . |
| 1527375 | 4/1968 | France . |
| 1368772 | 10/1972 | United Kingdom . |
| 1523552 | 9/1978 | United Kingdom . |

*Primary Examiner*—James R. Feyrer
*Attorney, Agent, or Firm*—Salter & Michaelson

[57] ABSTRACT

A noise-absorbing greenery-carrying structure (12) makes use of worn tires (7), which are divided by cuts extending from the central opening to the tire into tire-sectors (9) mutually connecting, the concave sides of which face towards a carrying frame (2), on which the tiresectors (9) are fixed in horizontal layers. The remaining hollow spaces inside the side walls of the tires, but also inside the central openings of the tires are filled with earth (13) suitable for the growth of greenery, which can preferably pass through openings (14) provided in the upper sidewalls of the tires (FIG. 1).

46 Claims, 5 Drawing Sheets

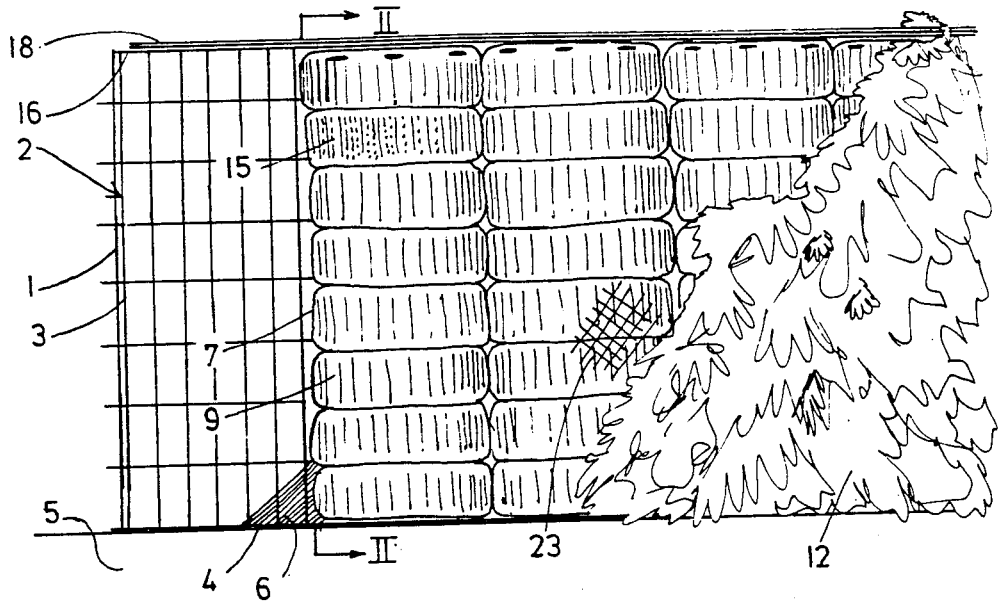
FIG. 1
FIG. 2
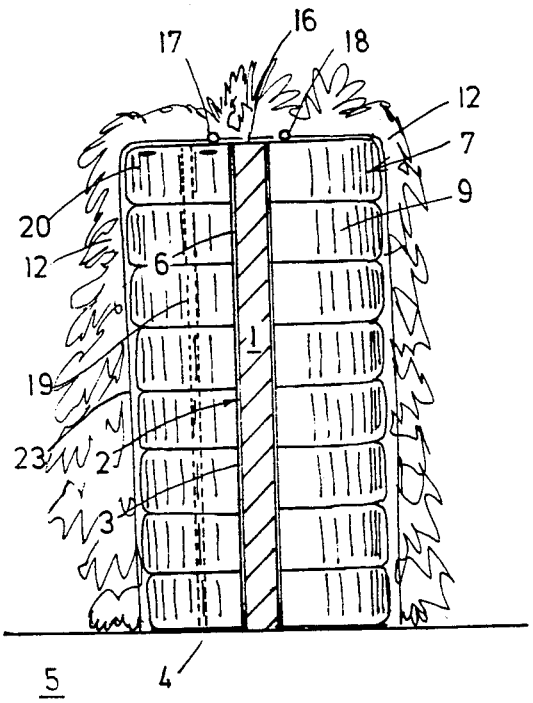
FIG. 3
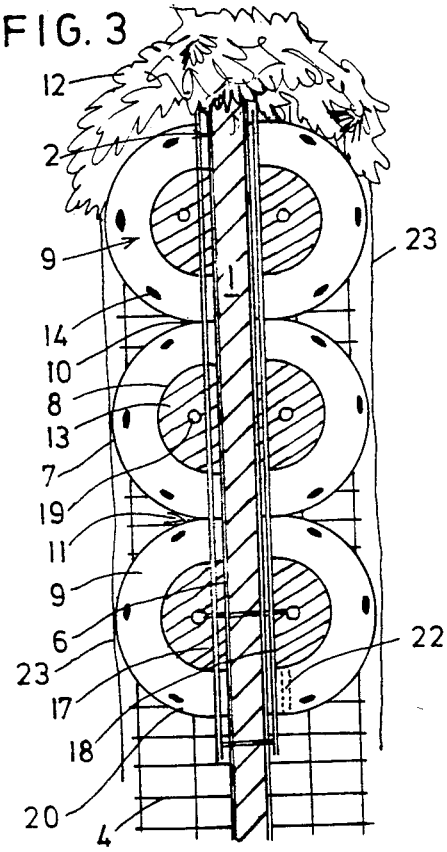

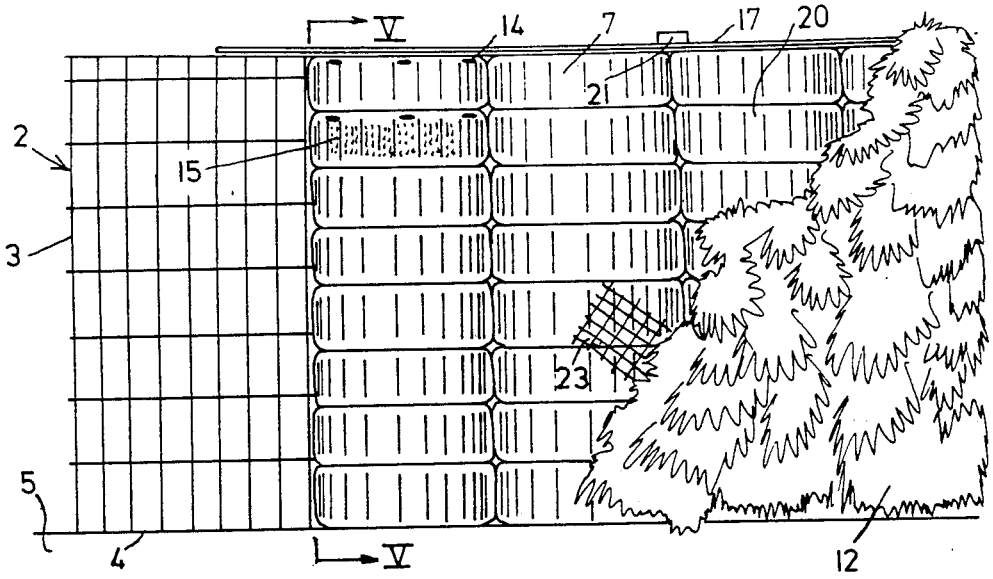
FIG. 4
FIG. 5
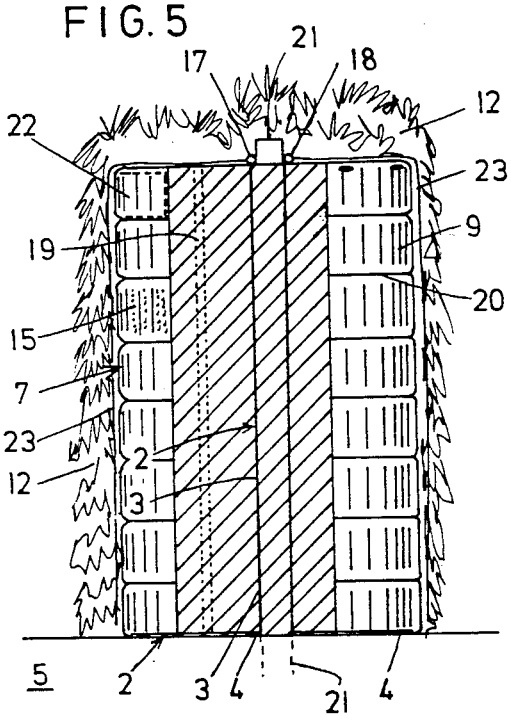
FIG. 6
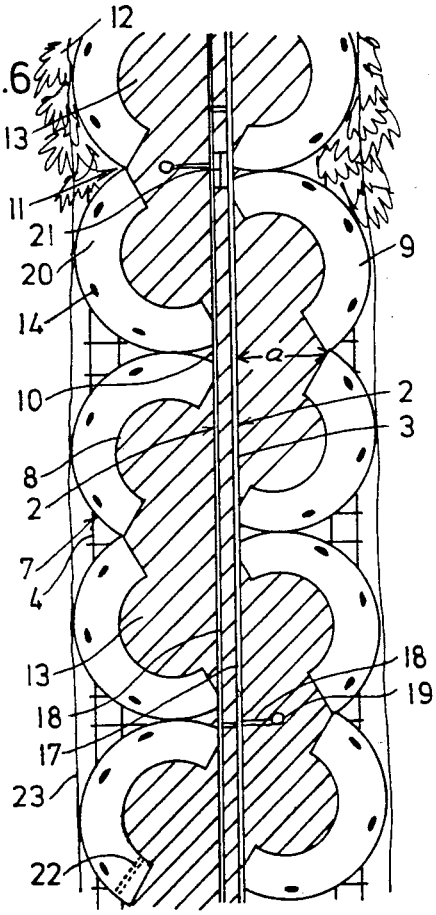

NOISE-ABSORBING CONSTRUCTION HAVING LIVE PLANTS

The invention refers to a noise-absorbing construction carrying a greenery, fi.i. for walls along thoroughfares, linings of walls, guide rails or other boundaries of roads, area barriers of similar, using a plurality of worn tires, at least the hollow spaces between the flanks of the tires containing some materia, f.i. earth, suitable for growth of the greenery.

It is known to erect noise-absorbing walls along highways or other sound sources, using concrete, steel, wood, synthetic plastics material and so on, which partially satisfy the acoustic demands, but mostly require an enormous expenditure and further do not satisfy with aesthetic and psychological aspects.

Also known are soundabsorbing buildings using worn tires, which is of advantage in respect of a profitable use of worn tires. F.i. it is known to face the two flanks of a slope of an earth dam with staggered layers of whole worn tires and to dispose plants over it. Also this solution shows the disadvantage of high expenditure in work and needs long time of erecting, which is especially impracticable for much frequented roads because of necessary diversions or roadblocks respectively. Besides of that such soundabsorbing earth dams require a relative large base area, which isn ot available everywhere.

The invention has for its object to avoid those disadvantages and to improve a noise-absorbing structure carrying a greenery, as described before, maintaining the advantage of the profitable use of worn tires in a way that the structure requires little space and further requires less expenditure of material and work and offers flexibility with respect to the desired height and configuration and shows a good optical impression. Further it is an object of the invention to securely keep the earth for the greenery and to protect it against the influence of salt, wind, rain and snow. Within such constructions, that must be prepared for the collision of vehicles, a good dampening of the impact must be given. Further it is desired to keep small the expenditure of maintenance and to provide for an easy demontabilty if necessary. The invention solves this task by dividing the worn tires into cohering tiresectors by cuts extending from the central tirehole, the concave sides of the tiresectors are facing a carrying framework on which the tiresectors are fixed. Such a construction offers an intense soudabsorption because of the uneven surface formed by the tiresectors and keeps the advantage of a profitable use for the worn tires, from which the tiresectors can be easily produced, particularly because generally there are only a few cuts necessary, often only two cuts, to produce the tiresectors. Only one of these cuts intersects the tire completely, the other cuts divide the tire only partially, so that the tire parts adjoining this cut remain connected with each other at least in parts of the tread. The mentioned arrangement of the tiresectors has the advantages of a very small ground area of the construction, so that such a constructing system can also be arranged in a place where there is no much space available or where a part of the existing space cannot be used, for instance in order to keep free an emergency passageway. The expenditure of work and material is comparatively small, especially in comparison with the above discussed construction of a faced earth dam, as the quantity of earth to be moved is much less within the construction according to the invention. The tire sectors make it possible to erect the construction almost in each desired height and configuration, so that there is a great flexibility with respect to the given conditions. Futher the construction according to the invention shows a much better optical impression than this is possible within the known soundabsorbing buildings, especially as the tire sectors well protect the earth material supported by them and therefore also the roots of the plants, because the tire sectors as it were form a protecting coat of rubber, which protects the earth against the bow-wave catapulted by passing vehicles, against the influence of salt, as well as against destructive influence of weather f.i. hail, pelting rain, snow and storm. Thereby the conditions of life for the greenery's plants are extremly improved, especially if plants are used for the greenery which are comparatively resistant against exhaust gases and salt.

A further advantage of the construction according to the invention is that the bow-shaped tire sectors offer a good impact-dampering function in case of collision of a vehicle so that a part pf the energy of impact will be transformed into energy of deformation for the elastic tire sectors. Thereby the damages on the vehicles, but also on the passengers and the existing constructional elements become smaller. In order to avoid the compressing of the tire sectors, it is practical to arrange spreaders between the flanks of tire.

According to a preferred embodiment of the invention, the carrying framework, which preferably is divided over the length of the construction, carries on its lower edge a horizontally protuding leg, for instance bent aside or welt on, which forms a support for the tiresectors arranged in layers one upon the other. Thereby it is possible to produce the carrying framework together with the tiresectors supported by it—usually without the filling earth—in a manufacturing plant and to bring it in this condition to the place of application, where the carrying framework only has to be erected or, respectively, has to be fixed on an already existing building. The horizontally protuding leg (or, if desired, two horizontal legs protuding in different directions) carries the the weight of the tiresectros during transport and at the same time it gives a temporary bearing surface and useful points of application for all kinds of liftingmeans, for instance cranes, lifting tackles and so on. Any little damages of the carrying framework occuring during transport are practically unimportant, particularly if, according to the invention, the carrying framework is a grid preferably of structural steel coated with zinc. Dividing the carrying framework over the length of the construction facilitates the said industrial pre-fabrication and said transport, because both can take place piece by piece. At the place of application just the material used for growth of the vegetation must to be brought into the hollow spaces confined by the tire sectors and the plants put in. This work can be done quickly, so that the working time at the place of erection and thus the necessary roadblocks, diversions and so on are reduced to a minimum.

According to a preferred embodiment of the invention the cuts between the connected tiresectors pass along the flank to about the tread of the tire. So it is not required to cut the tread, which is mostly rather strong, and the tread forms a flexible and solid junction of the tiresectors connected with each other, which can be easily spread out into a chain of tiresectors having substantially a straight course, irrespective whether the number of tiresectors forming this chain is small (at least 2) or is very great.

During the production of this construction it will be useful to arrange the parts of the central tireholes, confined by the tiresectors, so that they cover each other, preferably concentrically. This facilitates filling the hollow spaces withing the tiresectors from above, so that it is not necessary to fill each layer separately, but occasionally all layers together from the upper edge of the construction. Besides that the tireholes, passing down from above of the building-system formed by the construction, can then be used to receive any kind of installation, these installations taking at least substantially a straight course, generally in vertical direction. Within the spirit of the invention it then becomes possible to dispose a water-supply with attached dropping-pipes higher than the uppermost tire section layer, the water outlets of which pipes are located above the central tireholes of the uppermost layers of tiresectors. Then the water, which is occasionally mixed with fertilizer, can pass from layer to layer through the central tire openings to all the earth within the construction, particularly if according to a further embodiment of the invention perforate pipes adjoin the outlets of water and are filled with granulated material, preferably sand, and are wrapped round with an absorbent material, preferably felt, and reach into the lowermost layers of the tiresectors. Thus an equal water supply is ensured for the earth of the greenery keeping the consumption economically.

Occasionally the greenery grows through the gaps remaining between the tiresectors, in any case also from the upper edge of the construction up and down and gives a green impression to the tire sectors and thus to the whole construction or to the building to be faced by it in a well optical manner. The vegetation growing upwardly improves the prevention of blining. In order to enable the greenery the passage from inside of the construction also through the tiresectors, it is possible according to the invention to provide through-passing openings for the passage of the greenery plants in the tiresectors, especially on the upper tireflank. In order to ventilate the earth inside of the tiresectors, it is possible to provide through-passing holes in the tiresectors, especially on the tread region of the tire, which openings are preferably smaller than the openings for the passage of the plants.

In case the construction constiutes an attached panelling on an already erected building, f.i. for a wall, a moisture-proof foil, preferably of synthetic plastics material, may be disposed between the carrying framework and the tiresectors, in order to prevent a bad influence of wet earth on the building.

Facing of already erected buildings is not the only use of the construction according to this invention. Rather this construction may form a building itself, for instance the barrier of a roadway or it can be used for hiding of guide rails, so that these not only receive a better look, but also are made more elastic against impacts. Further fields of application are barriers of areas for instance of streets or parking lots and other purposes.

In the drawing there are shown schematically embodiments of the invention.

FIG. 1 shows the use of the construction for facing of a wall, whereby single parts are shown broken away in order to give a better impression.

FIG. 2 is a section along line II—II of FIG. 1.

FIG. 3 shows a top view to FIG. 1.

FIG. 4 is a variant of the construction wherein the construction itself forms the wall.

FIG. 5 shows a section along line V—V of FIG. 4.

FIG. 6 is the top view of FIG. 4.

Figure 7:
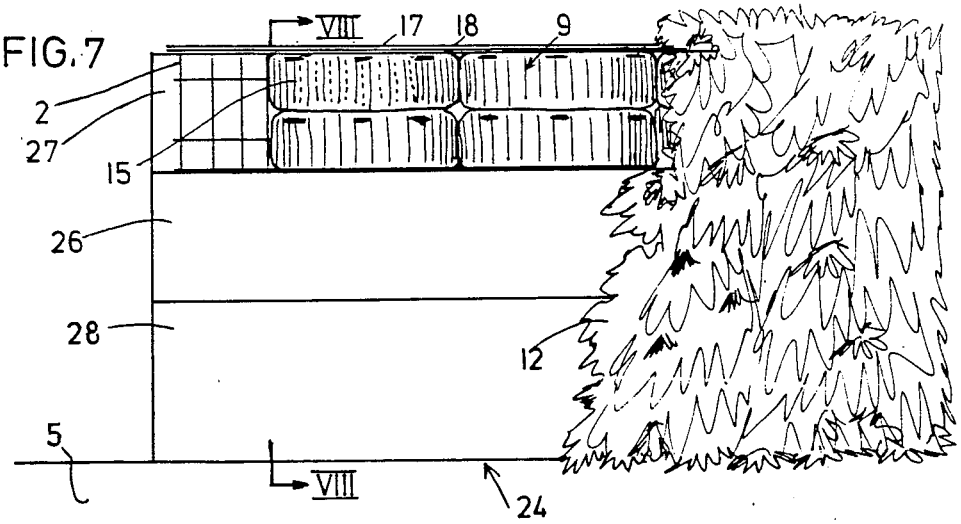
FIG. 7 shows in side-view the use of the invention applied as the boundary of a roadway.
Figure 9:
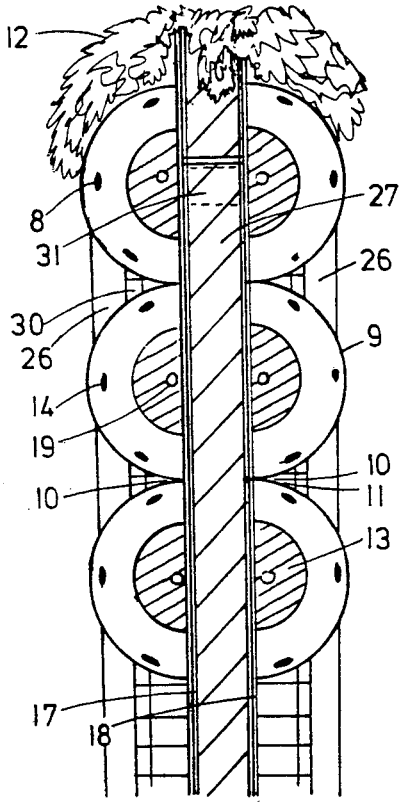

FIG. 9 a top view of FIG. 7.

Figure 10:
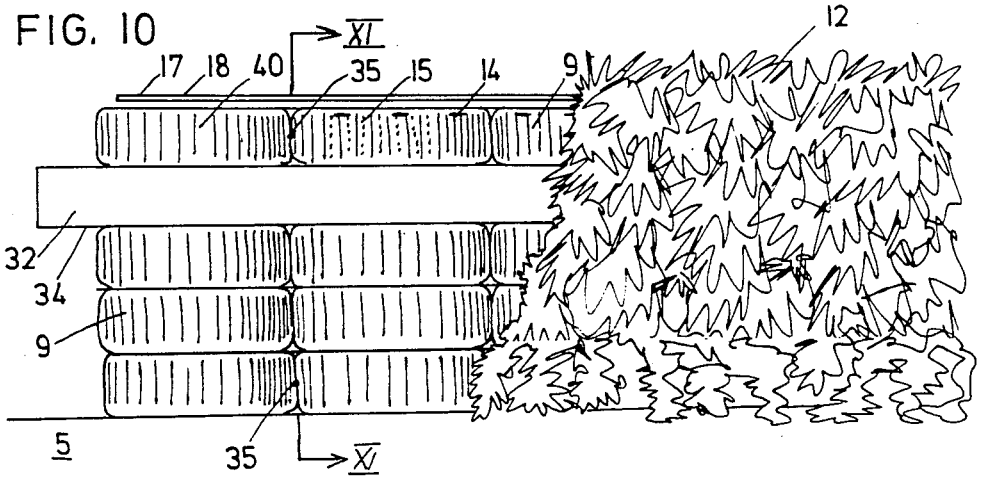

FIG. 10 shows in side-view the use of the invention in connection with the guide rail of a roadway.

Figure 11:
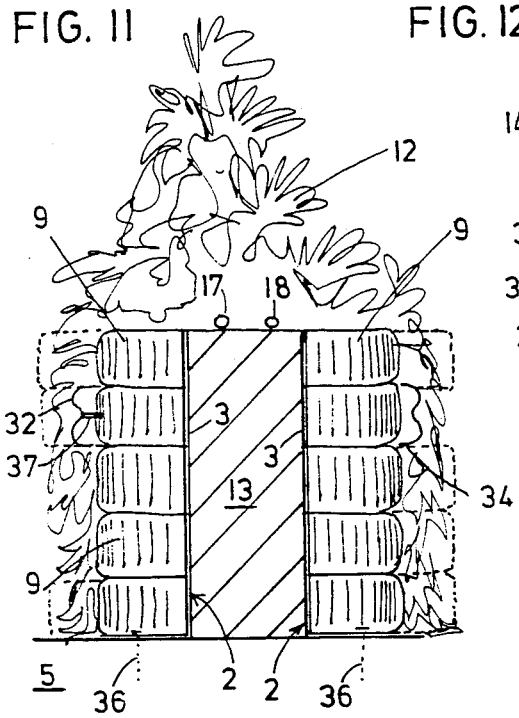

FIG. 11 is a section along line XI—XI of FIG. 10.

Figure 13:
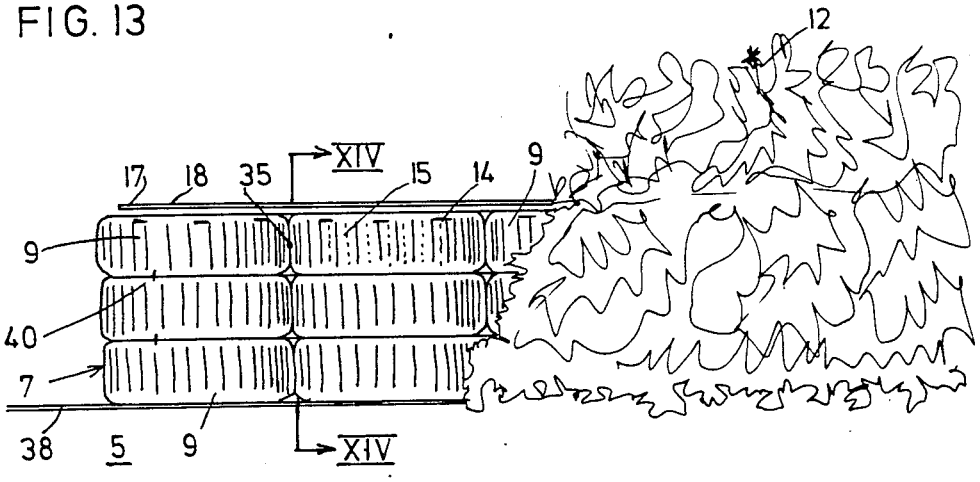

FIG. 13 shows the application of the invention for the barrier of an area.

Figure 14:
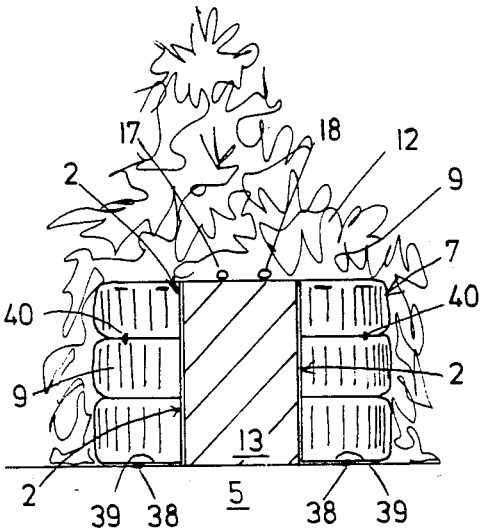

FIG. 14 is a section along line XIV—XIV of FIG. 13.

Figure 15:
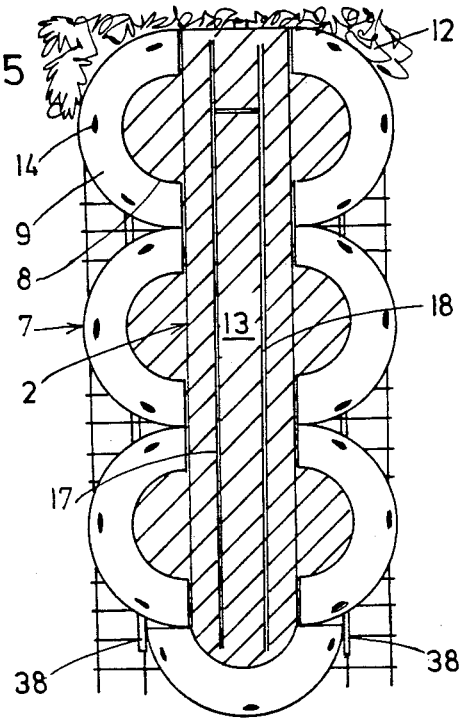

FIG. 15 is a top view of FIG. 13.

Within the embodiment of the invention according to FIGS. 1 to 2, a carrying framwork 2 formed by a trelliswork of structural steel is attached to the wall which is to be faced, for instance by pegs inserted into the wall, to which pegs the carrying framework is screwed. The carrying framework 2 has L-shape with one vertical leg 3 and one horizontal leg 4, the latter one being supported on the bearing ground 5 (FIG. 2), which is for instance constituted by foundation, wherein the wall 1 is anchored. The vertical leg 3 is covered by a moisuture-proof foil 6, especially made of synthetic plastics materials. A plurality of worn tires 7 is attached to the vertical leg 3 of the carrying framework 2. On each of those worn tires 7 there are two cuts starting from the central tirehole 8 (FIG. 3), one of these cuts dividing the tire completely, whereas the other cut takes its course from the tirehole 8 through the flank 20 to tread of the worn tire 7. In this way each of the worn tires 7 is divided into two tiresectors 9 connected with each other, the concave sides thereof being turned towards the carrying framework 2 and attached thereron. This fasteneing can be realized by any fastening 10, for instance wire-ropes, fixing-screws and so on. That fastening work is facilitated by the fact that each two tire sectors 9 are still interconnected at the zone 11 (FIG. 3) in the region of the tread of the tire, where the fastenings 10 can be fixed particularly suitable and easy. The single worn tires 7 or, respectively, the tiresectors 9 are arranged in a plurality of horizontal layers, so that the central tireholes 8 of the superimposed layers cover each other, when seen in vertical direction. The preferred embodiment shows these tireholes 8 in a concentric arrangement. Thus the material for a greenery 12, for instance earth 13, can easily be filled from above into the remaining hollow spaces, that means the hollow spaces near the tireholes 8, as well as the hollow spaces bounded by the tire-bulges. This filling can take place after finishing of the construction of worn tires 7 starting from the upper layer of worn tires 7, the earth 13 falling into the lowest layer of worn tires and fills it. In order to promote the growth of the greenery 12, through-passing holes 14 are provided in the tire sectors 20, particularly in their upper flanks, through which openings the plants of the greenery can grow through. Further there are additional holes for ventilation 15 (FIG. 1) provided in the area of the tread of tires for the earth 13 which is inside the tire bulges. To avoid that this earth 13 falls out through the holes of ventilation 15, these holes are smaller than the holes 14 for the trespassing of the plants 12. The water-supply of the vegetation 12 is realized by a water-pipe 17, arranged higher than the uppermost layer of worn tires 7. Dropping-pipes 18 are connected to the water-supply 17 in predetermined distances, which pipes are also situated above the uppermost layer of worn tires parallel to the water-supply 17 and which are equipped with outlets for water above the central tireholes 8 of the tiresectors. Perforated vertically extending pipes 19 are arranged below these water-outlets and are filled with granulated material, preferably sand, and are wrapped with absorbent material, preferably felt, and reach down to the lowermost layer of tiresectors 9. In this way a continuous water-supply to the earth 13 in all the layers of tiresectors 9 is guaranteed. The foil 6 prevents that the moisture reaches the carrying framework 2, or the wall 1, respectively.

The carrying framework 2 is divided along the length of the wall 1 in predetermining distances, these being suitably adapted to the position of the cuts intersecting the worn tires 7. So it becomes possible to prefabricate the carrying framework 2 together with the attached tiresectors 9 in a factory and to bring it, piece by piece, in a prefabricated condition to the place of application, where the earth 13 still has to be filled in and the plants of greenery have to be put in. During transport the horizontal leg 4 of the carrying framework 2 builds the bearing surface for the worn tires 7. In the mounted condition this leg 4 lies on the ground 5—flat condition and carrying capacity of the ground 5 being provided—so that the weight of the worn tires 7 as well as of the carried earth 13 and of the vegetation 12 is supported by the ground 5 so that the wall 1 is not loaded. In case there exists no carrying ground 5 before the wall 1 or if it is not possible there to fill up with earth to get carrying capacity or if this is to be saved, the carrying framework 2 together with the worn tires 7 supported by it and the earth 13 and the vegetation 12 can be suspended also at the wall itself as long as the static carrying capacity of the wall 1 is sufficient. In this case the fasteneing means 10 just have to be measured sufficiently.

Generally the construction that builds a greenplanted facing of the worn tires 7 will be located only on one side of the wall 1. As the drawing shows it is possible to provide this facing also on both sides of wall, if desired.

The presented embodiment shows each worn tire 7 only divided by two cuts in two tiresectors 9 connected with each other, only one of the cuts passing through, each of the tire sectors passing over an angle of 180°. Naturally dividing of the worn tire 7 into tiresectors 9 can also be realized by more than only one cut that does not pass through, so that from one worn tire 7 more than two tiresectors 9 can be built, which in special cases can also be of different length when measured in peripheral direction of the worn tire 7. In that way the distance between the frontal surface of the tiresectors 9 und the wall 1 can be adjusted at desire, this distance becoming the smaller the more tiresectors 9 are formed from one worn tire 7. In order to increase the volume of the earth 13 covered by the tiresectors 9, it is possible oto dispose the tiresectors 9 completely or partially spaced apart a distance from the carrying framework 2, in this case the fastening means 10 being made of f.i. of wire-loops.

Within the embodiment according to FIGS. 4 to 6 no central wall is provided, but vertical pillars 21 spaced apart from each other, anchored in the flat ground 5, to which pillars two carrying frameworks 2 are connected, one each of them attached on each side of the pillar 21. Each carrying framework 2 consists of a L-shaped trellis-work of structural steel, the two vertical legs 3 of the carrying structures being arranged adjoining each other back to back and being hardly connected with each other and also with the pillars 21, so that a solid carrying construction is achieved. The two horizontal legs 4 of the two carrying frameworks 2 show in opposite directions and are supported on the ground 5 and each of them carries a plurality of worn tires 7, which are divided in tiresectors 9 connected with each other as described before. The two tireflanks 20 (FIG. 5) of each tiresector 9 are stiffened by spreaders 22, f.i. pieces of wood, interposed between the tire flanks. The tiresectors 9 are attached again on the carrying frameworks 2 by fastening-means 10, in a way that only the two free ends of the interconnected tiresectors 9 engage the carrying framework 2, whilst the interposed parts of the tiresectors, especially on positions 11, where always two tiresectors 9 are connected with each other, are spaced apart a distance a from the carrying framework 2 (FIG. 6). If desired this distance can be secured by fastening means, f.i. wire-loops, arranged at these places 11. In that way the earth 13 in the tireholes 8 can be arranged more continuously which is helpful for the growth of the greenery 12. As mentioned before, also the free ends of the tiresectors 9 can be placed spaced apart a distance from the carrying freamwork 2, in order to give more room to the earth. For the saem reason the tiresectors 9 of one side of the erected construction are situated in a staggered relation relative to the tiresectors 9 on the other side thereof preferably staggered for half of the diameter of the tire (FIG. 6). If the earth can pass through the carrying framework 2, which is easily possible using a trellis-work of structural steel through the meshes thereof, there results a continuous wavy-lined configuration of the earth 13, seen from above (FIG. 6), which improves the soundabsorbing properties. The spreaders 22 guarantee that both tireflanks 20 of each tiresector 9 are kept spaced apart from each other, so that the earth 13 can completely fill the hollow-spaces of the tirebulges while put in. Further the pressure exerted by the upper layers of tiresectors 9 is transferred to the bottom, without squeezing out the earth 13 of the tiresectors 9.

Instead of two L-formed carrying framework 2, situated back to back, also only one carrying framework may be used which may be built up f.i. by a trellis-work of structural steel and has two horizontal legs on its lower edge looking in two different directions. The only one of these legs can be turned aside horizontally from the vertical leg 3, the other horizontal leg 4 is welded to the vertical leg 3 on the point of attachment.

At the view-side of the tiresectors 9, on the vertex thereof, a trellis-work 23 or a net can be attached, which enables those green plants of the greenery 12 to climb along, which grow through the holes 14. So a free swinging of these plants can be avoided.

Figure 8:
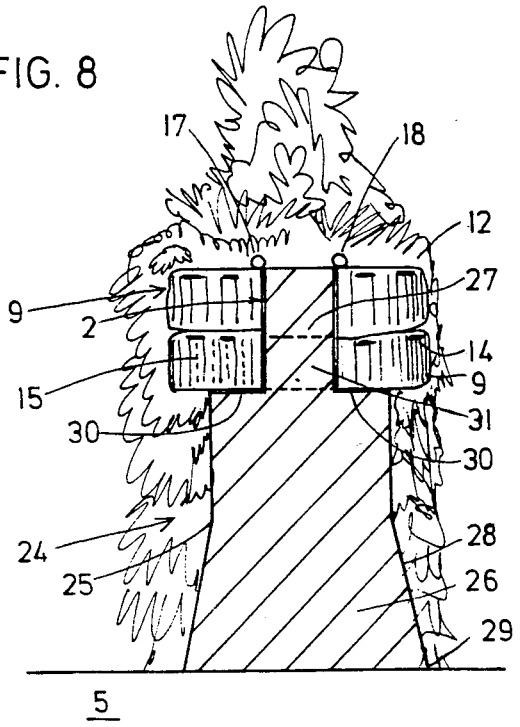
FIG. 8 is a section along line VIII—VIII of FIG. 7.

Such a construction comprising a greenery facing may be used with special advantage as the central greenery of roadways, but also a boundary of parking areas and on each place where it is desired to have a facing, which is green on both sides or where an area should be divided. Within the embodiment according to FIGS. 7 to 9 the construction formed by the greened tiresectors 9 is used to make a barrier 24 a roadway soundabsorbing and resistant against impacts and also to give it a better look. The barrier of a roadway has a body member 25 of ferro-concrete, which consists of a base member 26 and a leg 27 extending upwardly from the middle of the member 26. The basemember 26 has bevels 28 on both sides and, as already known, it helps to guide back any vehicles getting away from the roadway 29. The barrier 24 of the roadway can be placed just in the middle between two roadways, f.i. like the central reserve of a highway, and may be situated symmetrically with respect to a vertical plane. The base member 26 forms with its top surface 30 situated on both sides of the leg 27 a support for the tiresectors 9, which are arranged in horizontal layers placed one over the other and are attached on the leg 27 by fastening-means 10. As hard stresses by collision of vehicles are to be expected, the tiresectors contact with their cut surfaces the leg 27 and are fixed on same, using a suitable carrying framework 2, like in the embodiment according to FIGS. 1 to 3. The tiresectors 9 may completely cover the leg 27, to give a better look and in case of the use of the central reserve of a roadway also improve the prevention of blinding, especially if the plants of vegetation 12 grow over the upper edge of the uppermost tiresectors 9 (FIG. 8). The water-supply to the earth 13 which is within the hollow-spaces of the tiresectors 9 can be realized either by using perforate pipes 19, as described before, or by connecting the water-outlets of the dropping-pipes 18 with cross channels 31 or crossing grooves in the leg 4, which guide the water from the water-outlet openings of the dropping-pipes 18 to the earth 13.

Such a barrier 24 of a roadway, which is to be situated along the length of the road, will be fixed on the ground 5 or on the road 29 by anchoring means not shown, f.i. ground anchors. As the tiresectors 9 and the earth 13 contained in them are of little weight compared with the constructional member 25 of ferro-concrete, the barrier of the roadway can be transferred along the ground 5 or along the roadway 29 after breaking the anchoring, as far as its weight admits this, which can be obtained by dividing it along the length. Occasionally the leg 27 can be saved, if the tiresectors 9 are hold on the upper part of the base-member 26 by the carrying framework 2 such that their concave sides are turned towards each other or, respectively, towards the middle plane of the body member 25 of ferro-concrete.

Figure 12:
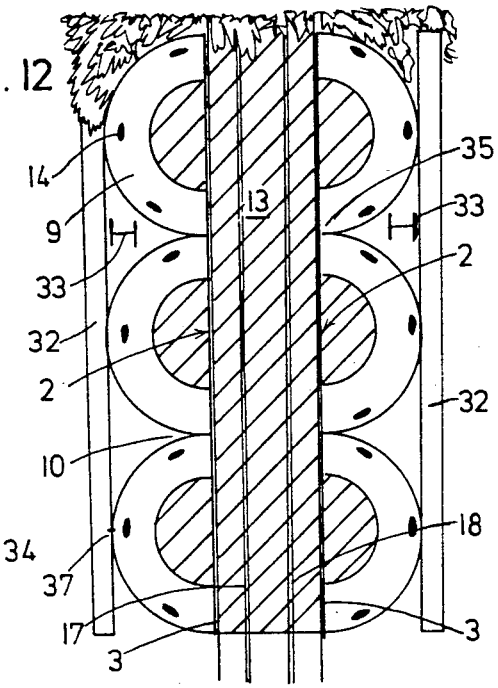

FIGS. 10 to 12 show the application of the construction built up by tiresectors 9 for a greenery carrier member for a safeguard rail 32, usually located along the length of a roadway and fixed in the ground 3 by pillars 33 (FIG. 12). The described embodiment shows the central reserve of a highway, two safeguard rails 32 are disposed parallel to each other (FIGS. 11, 12). The space between the ground 5 and the lower edge 34 of the two safeguard rails is filled with tiresectors 9 connected with each other produced in the described way, which are arranged in the shown example in two parallel rows and in a plurality of superimposed layers and are hold in this position by a carrying framework 2 which is based and fixed on the ground and on which the tiresectors 9 are fastened by the fastening-means 10. The tiresectors 9 are arranged in three layers between the lower edge 34 of the safeguard rail 32 and the ground 5 (FIG. 2), whilst the fourth layer of tiresectors 9—counted up from the ground 5—is placed on about the same level as the safeguard rail 32 but behind it and the uppermost (fifth) layer is situated higher than the safeguard rail 32. In case of a lower disposed safeguard rail 32 or, respectively, of very large tiresectors 9, only one or two layers of tires may be located between the ground 5 and the safeguard rail 32. The space resting between the vertical legs 3 of the two carrying framework 2 is filled with earth 13, which, through the holes of the trellis-work of steel of the carrying framework 2, is in connection with each earth inside of the hollow-spaces of the tiresectors 9. The earth can be mixed up with compost or fertilizer, respectively.

Ad shown in FIG. 11, the periphery of the view-side of all tiresectors 9 stands back behind that profile of the safeguard rail 32, which faces the road. However the arrangement can also be done in the way (shown by dotted lines in the lower part of FIG. 11), that some or all of the tiresectors 9 protude beyond the profile of the safeguard in direction to the roadway. The several tire sector layers may also be disposed with their profile facing the roadway a stepped arrangement.

The tiresectors 9 extending over 180 degrees are connected in pars by cuts that do not go through, the pairs being connected with each other by additional clamps 35. Further junctions of the packages built up by the tiresectors 9 or, respectively, of the carrying frameworks 2 carrying the tiresectors with the ground 5 are provided, for instance in form of anchoring bolts 36 (FIG. 11) and, respectively, or with the safeguard rail 32, for instance also by screwed-connections 37.

Within the embodiment according to FIGS. 13 to 15 the construction built up by the tiresectors 9 is used as barrier of an area, for instance of a parking-space. For this purpose worn-tires 7 divided into tiresectors, 9 connected with each other in the described manner, are attached on a carrying framework 2 the concave sides of the tireholes 8 facing the framework, the carrying framework 2 being additionally stiffered by tubes 38 of steel coated with zinc laying on the bottom and being connected by clamps 39 with the lowermost layer of tiresectors 9. Further connecting means 40, for instance clamps, join the tiresectors 9 of each layer one with the other and also the single tiresectors 9 of the same layer, as far as they are not yet connected with each other in the area of their treads. The tiresectors 9 situated on both sides of the construction are placed in a predetermined distance from each other, which is filled by the earth 13 for the greenery 12. Also the front-sides of the barrier tiresectors 9 may be provided, which are produced in a similar way like those which are used for the sidewalls of the construction. In order to well keep in place the tiresectors 9 on the front-sides of the construction, the carrying framework 2 have also legs protuding inwardly and resting on the ground 5, on which legs the lowermost layer of the front-sided tiresectors 9 is fixed. In this way also the earth 13 inside of the tiresectors 9 of the whole construction is well kpt in place. It is possible to admix to this earth a material favouring the growth of the vegetation 12, f.i. compost, fertilizer and so on. For a better understanding FIG. 13 shows the green vegetation 12 only for the right side of the construction, but in practice it covers the construction completely and therefore covers all tiresectors 9, so that a smart, ecologically and psychologically beneficial look of the construction or, respectively, of the barrier formed by it will be given. This barrier can be easily loaded, if desired, divided in parts along the length of the construction, piece by piece by means of the steeltubes 38 f.i. by carne, so that these parts of the barrier (mostly without the earth 13) may be prefabricated in a factory and may be transported in this condition without substantial problems to the place of application. At this place the hollow spaces can be filled with earth 13 and the plants used for the greenery 12 can be put in quickly and easily. It is also possible to tranfer the whole barrier without problems.

Within the example of application shown all the tiresectors 9 are of the same size. This brings the advantage of substantially vertically extending barrier walls of the construction, particularly on the adjacent surfaces, on which the sections of the barrier are neighbouring each other, so that almost no gaps rest between two neighboured sections. Eventually remaining gaps are covered by the greenery 12. If desired, however, the arrangement can also be such, that the tiresectors 9 of the single layers or, if desired, also within the same layer, show different dimensions, whereby a predetermined contour of the construction can be realized.

The single sections of the construction may just be placed on the ground by means of the tubes 38 of steel, as the weight of the single longitudinal sections of the barrier, already due to the filling of earth, normally is sufficient to avoid an undesired displacement, if the acting stresses are not too heavy. If necessary, the single sectors of the construction can also be fixed on the ground 5, for instance by brackets or anchoring screws attached on the steel tubes 38. In this case the L-formed or T-formed carrying frameworks 2 are suitable welded on the steel tubes 38. The steel tubes together with the carrying framework facilitate the transport of the construction, if necessary piece by piece, and support the carrying framework 2 which is carried thereon. In order to avoid the earth from falling through during transfer of the construction, a foil of synthetic plastics material rests on the horizontal leg of the carrying framework 2, which is formed by a trelliswork of constructional steel.

Preferred fields of application for such barriers are barriers for the central reserve or for the lateral borders of roadways and also barriers parkingplaces, but such barriers are applicable in a profitable way at every place, where a good-looking and resistent barrier of an area is requested.

I claim:

1. A noise absorbing structure adapted for supporting living plants, said structure comprising a framework carrying a plurality of played, worn tires having sidewalls, each of said tires having two ends and being provided with at least one cut extending in each sidewall a selected distance towards teh tread layer, thereby forming a hinge, so that each worn tire is divided into mutually connected tire sectors, the concave sides of said tire sectors facing said framwork, the convex sides thereof defining an outwardly facing surface, fastening means for fixing said tire sectors to said framework, and material suitable for the growth of said plants filling at least the hollow spaces defined between said sidewalls of the tire sectors, and means allowing plants to extend to at least the outwardly facing surfaces from the interior of each tire sector.

2. Structure according to claim 1, wherein said framework is subdivided over its length into framework sections.

3. Structure according to claim 1, wherein said framework comprises a horizontal leg on its lower edge, said leg consituting a support for said tire sectors resting on said leg in superimposed layers.

4. Structure as claimed in claim 1, wherein said framework is a trellis-work.

5. Structure as claimed in claim 4, wherein said trelliswork consists of a steel grid covered with zinc.

6. Structure as claimed in calim 1, wherein each of said worn tires comprises a tread layer, said cuts in said worn tire intersect said side walls and extend to about said tread layer.

7. Structure as claimed in claim 1, wherein the original worn tires are disposed in superimposed layers, each tire sector confining a sector of said central tire opening, said tire opening sectors covering each other in superimposed layers.

8. Structure as claimed in claim 7, wherein said tire sectors are disposed in aligned superimposed layers.

9. Structure as claimed in claim 1, wherein said means allowing plants to pass to the outwardly facing surfaces comprises openings in said tire sectors.

10. Structure as claimed in claim 9, wherein said openings are provided in the upper side walls of said tire sectors.

11. Structure as claimed in claim 9, wherein said openings for said living plants are larger than said ventilation openings.

12. Structure as claimed in claim 1, wherein said tire sectors are provided with ventilation openings for ventilating the material for the growth of said living plants.

13. Structure as claimed in claim 12, wherein said tire sectors are provided with tread regions, said ventilation opening being provided said tread regions.

14. Structure as claimed in claim 12, wherein said openings for said living plants are larger than said ventilation openings.

15. Structure as claimed in claim 1, further comprising a water supply pipe disposed above said tire sectors and being provided with water outlet openings, and further comprising dropping lines effecting communication between said water outlet openings and the concave side of said tire sectors of the uppermost layer of tire sectors.

16. Structure as claimed in claim 15, further comprising perforated tubes extending from the lowermost layer of tire sectors upwardly to said water outlet openings, filling each perforated tube, and a layer of absorbent material surrounding said perforated tube.

17. Structure as claimed in claim 16, wherein said granulated material is sand.

18. Structure as claimed in claim 16, wherein said absorbent material is felt.

19. Structure as claimed in claim 1, further comprising a moisture-proof foil disposed between said framework and said tire sectors.

20. Structure as claimed in claim 1, wherein said foil consists of synthetic plastics material.

21. Structure as claimed in claim 1, wherein tire sectors are disposed on both sides of the framework.

22. Structure as claimed in claim 21, wherein the tire sectors are disposed in staggered relation from side to side of said framework.

23. Structure as claimed in claim 22, wherein the tire sectors of the one side of the framework are staggered with respect to the tire sectors of the other side a distance of half of the diameter of the tire.

24. Structure as claimed in claim 21, wherein said framework includes at least two subframes, one subframe mounting a side of said tire sectors, and means connecting said at least two subframes.

25. A structure as claimed in claim 21, wherein said framework comprises a single frame having two sides, and tire sectors disposed on each side of said single frame.

26. Structure as claimed in claim 1, wherein said tire sectors comprise a plurality of layers, at least the layer of tires including spreader means for spreading the sidewalls of said worn tires.

27. Structure as claimed in claim 1, further including means for connecting said hinges to said framework, said connecting means having a length so as to dispose said hinges a distance from said framework whereby a hollow space is formed between the framework and said covering tire sectors, said space being filled with material suitable for the growth of the plants.

28. Structure as claimed in claim 1, further comprising a plant support means adjacent to said outwardly facing surfaces.

29. Structure according to claim 28, wherein said plant support means is a grid.

30. Structure as claimed in claim 28, wherein said plant support means is a net.

31. Structure as claimed in claim 1, further comprising a wall, said tire sectors being disposed at least one one side of said wall and constituting a paneling for said wall.

32. Structure as claimed in claim 1, further comprising a reinforced concrete member having an upright leg, said tire sectors being arranged in at least two layers on at least one side of said leg and having the concave sides of said tire sectors facing said leg, said tire sectors forming a paneling for said leg.

33. Structure as claimed in claim 1, further comprising a safeguard rail fixed to the ground by pillars, said safeguard rail having a lower edge, said tire sectors being located in at least two horizontal layers between the ground and said lower edge of said safeguard rail, said tire sectors being connected with each other.

34. Structure as claimed in claim 33, further including means connecting at least the bottom of said horizontal layers to the ground.

35. Structure as claimed in claim 33, further including means connecting at least one of the said horizontal layers to said safeguard rail.

36. Structure as claimed in claim 33, wherein said safeguard rail includes an outwardly facing profile, and wherein at least one of said convex sides extends a distance from said framework which exceeds the distance between said framework and said outwardly facing profile.

37. Structure as claimed in claim 33, wherein said convex sides of at least one of said horizontal layers extend a distance from said framework which exceeds the distance between the framework and the convex sides of the remainder of the horizontal layers.

38. Structure as claimed in claim 37, wherein the layers of the tire sectors protrude stepwisely relative to said framework.

39. Structure as claimed in claim 33, further including at least one top layer of tire sectors lying above said safeguard rail, and means connecting said at least one top layer to said safeguard rail.

40. Structure as claimed in claim 39, further including means connecting said at least one top layer to said at least two horiziontal layers.

41. Structure as claimed in claim 39, wherein said safeguard ril includes a profile spaced a specific distance from said framework, and wherein at least a portion of the convex side of said at least one top layer lies a distance from said frame work which exceeds the distance of said profile from said framework.

42. Structure as claimed in claim 1, including a plurality of layers of tire sectors and further comprising carrying members passing along the length of the structure and being placed below the lowermost layer of tire sectors, first means connecting said carrying members to said lowermost layer, the tire sectors of the remainder of said plurality layers being connected with each other by fastening means separated from said first connecting means.

43. Structure as claimed in claim 42, wherein said carrying members consist of rigid material and include ground anchor means.

44. Structure as claimed in claim 43, wherein said carrying members are formed by steel tubes.

45. Structure as claimed in claim 42, wherein said fastening means are clamps selected from the group of clamps or screws.

46. Structure as claimed in claim 42, wherein said fastening means are screws.

* * * * *